US005344319A

United States Patent [19]

Manzke

[11] Patent Number: 5,344,319

[45] Date of Patent: Sep. 6, 1994

[54] SHOOT AND KILL INDICATOR

[75] Inventor: Walter R. Manzke, Julian, Calif.

[73] Assignee: Cubic Defense Systems, Inc., San Diego, Calif.

[21] Appl. No.: 58,211

[22] Filed: May 10, 1993

[51] Int. Cl.[5] ..... B05B 1/24

[52] U.S. Cl. ..... 434/14; 102/334; 434/12

[58] Field of Search ..... 102/334, 395, 498, 513; 40/213; 73/170.04; 434/11, 12, 14–17

[56] References Cited

U.S. PATENT DOCUMENTS 3,990,987 11/1976 Rogers ..... 73/170.04
4,202,246 5/1980 Schertz et al. .
4,459,219 7/1984 Kiley ..... 102/334 X
4,618,224 10/1986 Smith .
4,695,059 9/1987 Yamashita et al. .
4,700,628 10/1987 Varmo ..... 102/334
5,002,490 3/1991 Blackstone .

*Primary Examiner*—Richard J. Apley
*Assistant Examiner*—Glenn Richman
*Attorney, Agent, or Firm*—Brown, Martin, Haller & McClain

[57] ABSTRACT

An airborne wind-driven electrical generator provides electrical current to the resistance wire of a smoke generator, which receives a smoke-producing fluid from a reservoir. A valve controls the flow of fluid to the smoke generator in response to control signals, which may indicate a simulated weapon firing or simulated weapon hit in an airborne weapon training system.

12 Claims, 2 Drawing Sheets

SHOOT AND KILL INDICATOR

BACKGROUND OF THE INVENTION

The present invention relates generally to aerial combat training systems and, more specifically, to a device for producing smoke signals indicative of a simulated missile firing or a simulated missile hit in an aerial combat training system.

Aerial combat training systems are used by the military to train both air and ground-based personnel in the use of missile systems. Such systems may be air-to-air or surface-to-air. Such systems simulate the firing of a missile and indicate whether the target aircraft would have been hit if an actual missile had been fired. Electronics at the location from which the simulated missile is fired directs a radar or laser beam toward the target aircraft, which has electronics that detects whether the beam impinges upon it. If the beam impinges upon the target aircraft, the target aircraft electronics produces a data signal indicating a "hit." A ground station receives the hit detection data from the target aircraft electronics via a radio link. The airborne electronics may be located in a missile-shaped training pod that is attached to the aircraft in the same manner as a real missile. The training pod may be fashioned to duplicate the weight and aerodynamic behavior of a real missile.

The aircraft itself is not modified in any way to accommodate the training pod. Thus, in the case of an air-to-air firing simulation, personnel at the ground station must radio the pilot of both aircraft to tell them the outcome of a missile firing. Similarly, in the case of a surface-to-air firing simulation, personnel at the ground station must radio the firing personnel to tell them whether they have hit the aircraft and must radio the pilot of the aircraft to tell him whether he has been hit. There is thus a need in the art to automatically provide air and ground personnel involved in the simulation with indications of the outcomes of simulated missile firings.

The present invention solves these problems by using a smoke generator aboard the target aircraft to indicate whether a missile has "hit" the target aircraft or aboard an attacking aircraft to indicate whether it has "fired" a missile. Smoke generators known in the art commonly have a resistance coil that burns or boils oil or other fluid received from a fluid supply to produce smoke. However, the resistance coil requires a large amount of electric current, and the training pod has no means for receiving sufficient electrical power from the aircraft; nor can the pod carry a sufficiently large battery for operating a smoke generator over extended periods of time without exceeding the weight of the missile it is designed to simulate. In addition, it would be desirable to minimize the amount of fluid carried to both minimize weight and to avoid problems caused by shifting weight as the fluid is used. These problems and deficiencies are clearly felt in the art and are solved by the present invention in the manner described below.

SUMMARY OF THE INVENTION

The present invention comprises a wind-driven electrical generator or alternator that provides electrical current to the resistance wire of a smoke generator or heater, which receives a smoke-producing fluid from a reservoir. The fluid may be oil, brake fluid, antifreeze, or any other suitable fluid that produces visible smoke or vapor when heated. The word "smoke" is used herein only to designate a visible product of heating the fluid and is not intended to limit the product to that which is produced by the chemical processes of incomplete combustion. Rather, the chemical processes that occur in the heater are unimportant to the present invention and may include any combination of combustion, vaporization or other processes.

The present invention may be used for providing a visual indication in any airborne system. In an illustrative embodiment, the present invention may be enclosed within a missile training pod that is attached to a military fighter aircraft. The rotor assembly is attached to one end of the pod to drive the generator as the pod moves through the air.

The present invention may also include a smoke control means. In the illustrative embodiment, the smoke control means is operated by signals produced by the existing pod electronics. The smoke control means may comprise a valve, a pump, or any other suitable mechanism for controlling the flow of fluid to the heater. A smoke control circuit may be used to create a smoke signal in response to the fire detection signal that is visibly distinguishable from a smoke signal it creates in response to the hit detection signal. For example, the fire detection smoke signal and the hit detection smoke signals may each consist of a single burst of smoke but of different duration. Alternatively, the fire detection smoke signal and hit detection smoke signal may each consist of a different number of bursts of smoke. Either method or any combination of them that produces visibly distinguishable smoke signals is suitable.

The electrical generator not only provides a convenient power source but also minimizes fluid consumption by producing less heat (and less smoke) at lower airspeeds than at higher airspeeds. Thus, as the airspeed of the aircraft increases, the amount of smoke generated automatically increases, thereby burning the minimum amount of fluid needed to ensure that the smoke signals are visible at all airspeeds.

It should be noted that the present invention is useful with any type of airborne system where a visual indication is desired, and is not limited to missile training pods. For example, the present invention may be used with non-military aerial combat simulation systems that are used for entertainment.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF THE PREFERRED EMBODIMENT

Figure 1:
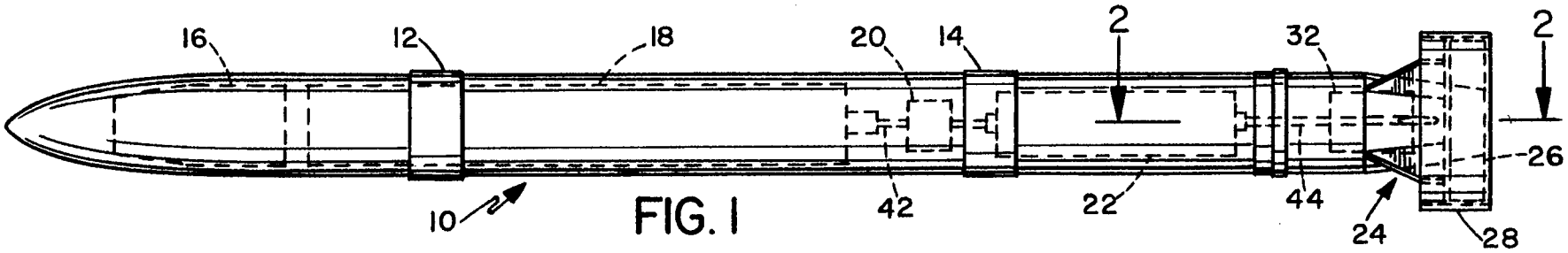
FIG. 1 is a side elevation view of a typical missile-type training pod containing the smoke indicator system.

In FIG. 1, a missile training pod 10 has fore and aft hangers 12 and 14 for attaching pod 10 to an aircraft (not shown). Pod 10 encloses pod electronics 16, a fluid reservoir 18, a valve 20, a heater 22, and an electrical generator 32. A rotor assembly 24 is attached to the aft end of pod 10.

Figure 2:
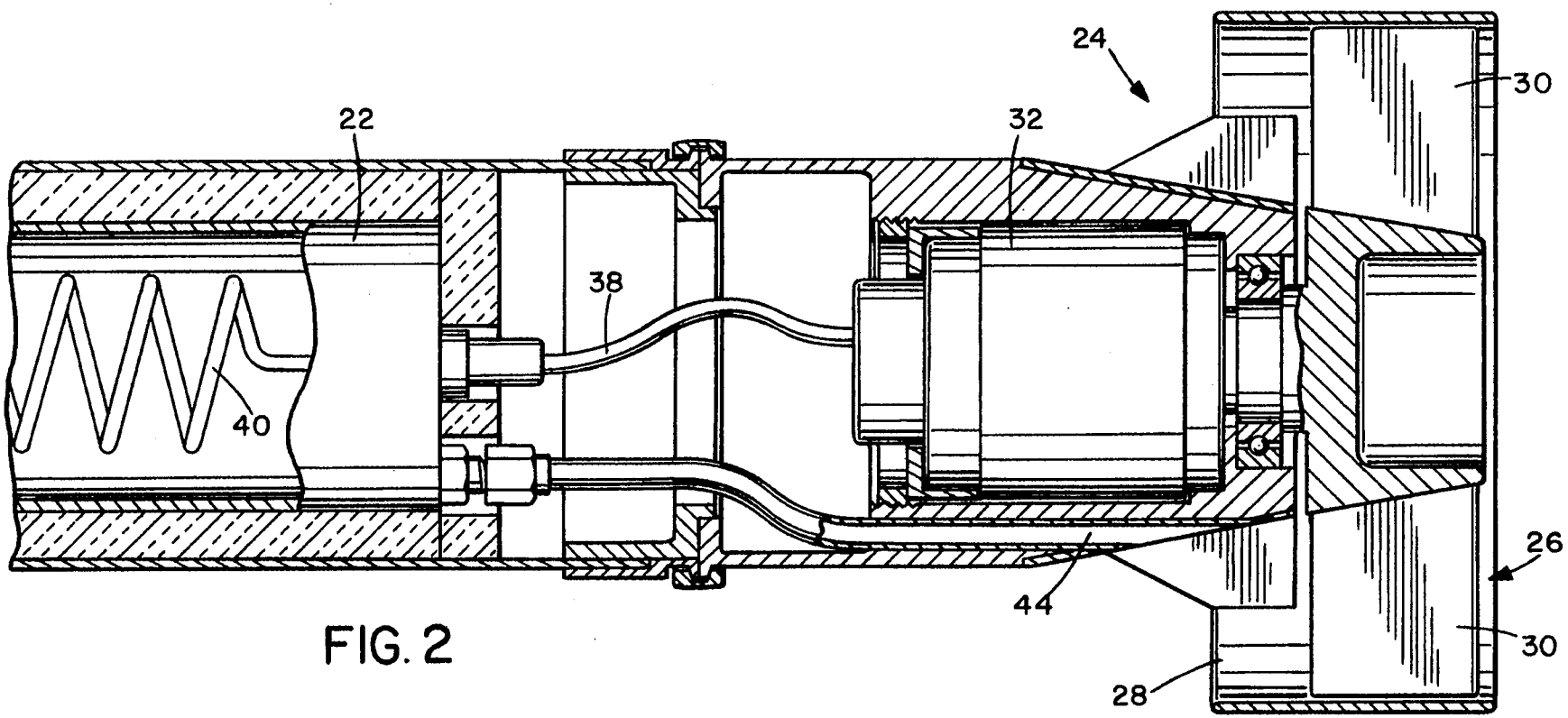
FIG. 2 is an enlarged sectional view taken on line 2—2 of FIG. 1.
Figure 3:
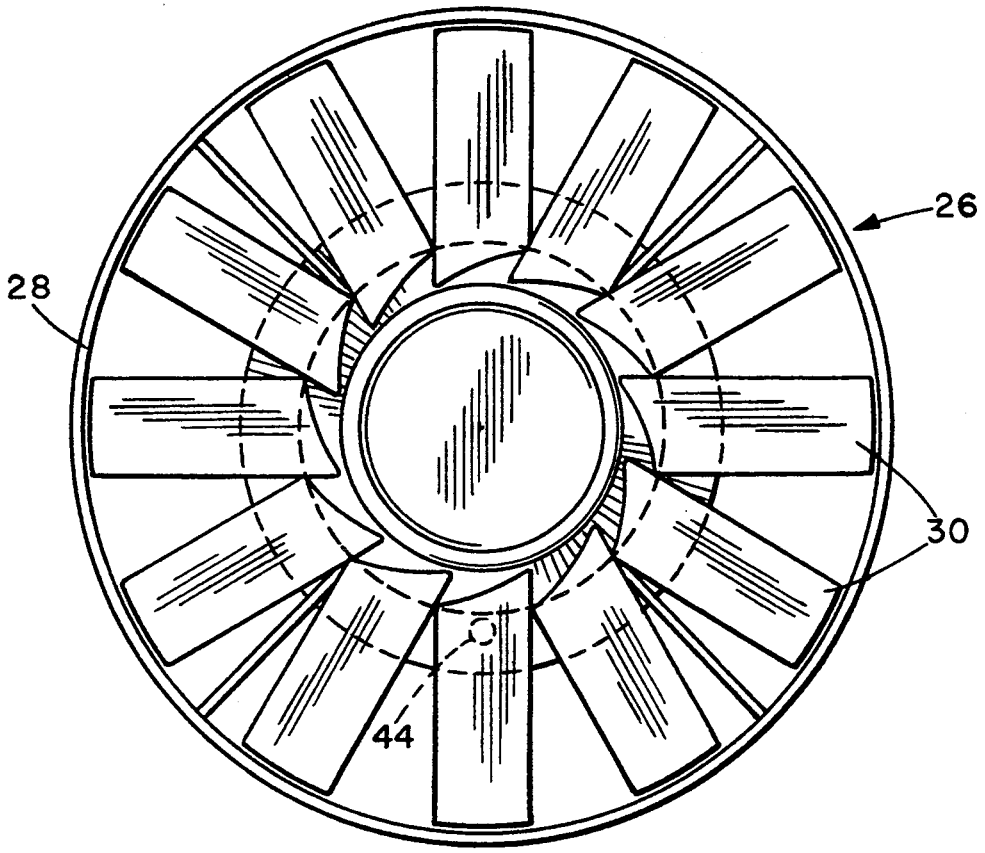
FIG. 3 is a rear end view of the structure of FIG. 2.
Figure 4:
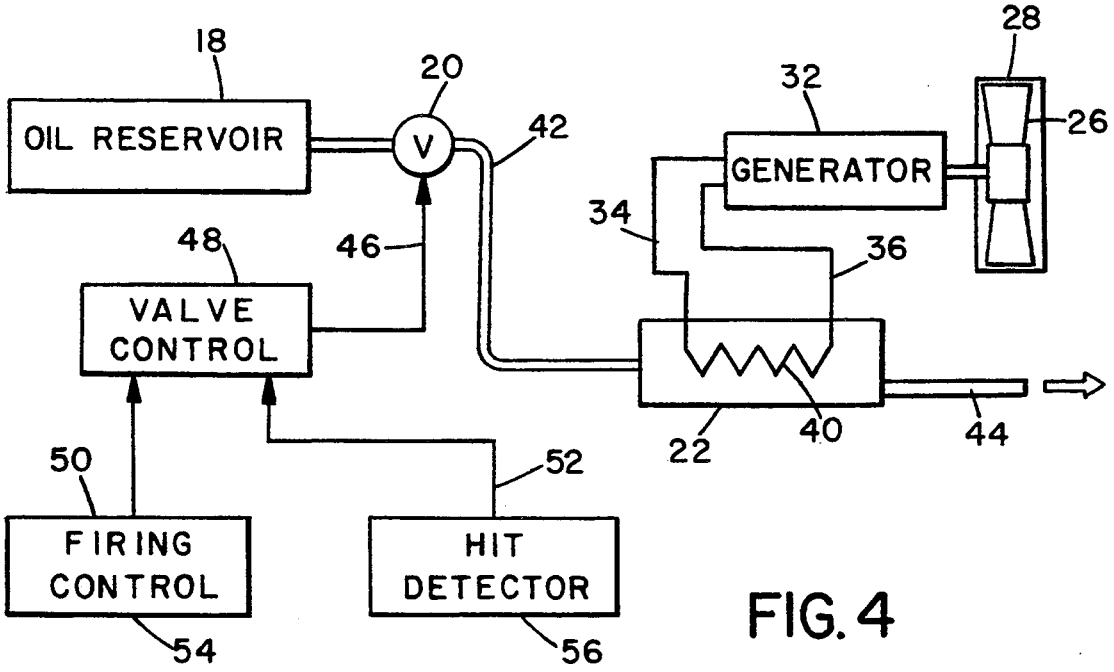
FIG. 4 is a diagram of the smoke generation and control system.

In FIGS. 2–3, rotor assembly 24 comprises a rotor 26 and a surrounding shroud 28. Rotor 26 may have any suitable number of blades 30. Rotor 26 is connected to generator 32. As pod 10 moves through the air, rotor 26 turns generator 32, which creates a current in wires 34 and 36, as shown in FIG. 4. Wires 34 and 36 are contained in a cable 38 that is connected to heater 22. The ends of a resistance wire 40 inside heater 22 are connected to wires 34 and 36 to create heat in response to the current. Resistance wire 40 may be made of any suitable material that produces a large amount of heat when it carries a current.

Heater 22 receives fluid from reservoir 18 through a heater inlet pipe 42 and allows the smoke to exit through a heater outlet pipe 44. Heater outlet pipe 44 exits pod 10 at the aft end adjacent rotor 26.

Valve 20 is disposed at a point along conduit 42 and controls the flow of fluid in conduit 42 in response to a valve control signal 46. Reservoir 18 may be pressurized to facilitate the outflow of fluid. In other embodiments, a pump may be disposed along valve 42. In such embodiments, valve control signal 46 may control the pump in addition to or in lieu of controlling a valve.

A valve control circuit 48 receives a fire control signal 50 and a hit detection signal 52 from the existing firing control circuitry 54 and hit detection circuitry 56, respectively, of pod electronics 16. Pod electronics 16 is known in the art and is not described herein. Valve control circuit 48 essentially operates by momentarily opening valve 20 to allow fluid to flow from reservoir 18 to heater 22 when it receives either fire control signal 50 or hit detection signal 52. Valve control circuit 48 is not shown in detail because a suitable circuit can be readily constructed by persons skilled in the art. Valve control circuit 48 may be quite simple in this embodiment because it operates in response to only two signals. However, in other embodiments, valve control circuit 48 may operate in response to more than two signals and may thus comprise devices that provide flexibility in controlling valve 20, such as a read-only memory or a microprocessor.

Regardless of how valve control circuit 48 is constructed, fire control signal 50 should operate valve 20 a way that is sufficiently different from the way that hit detection signal 52 operates valve 20 to allow pilots or ground personnel to distinguish the resulting smoke signals. As discussed above, the smoke signal that indicates a simulated missile firing and the smoke signal that indicates a simulated missile hit may, for example, each consist of one or more bursts of smoke having unique durations or having a unique pattern. In embodiments where valve control circuit 48 operates in response to a larger number of signals, valve control circuit 48 may produce a corresponding number of unique smoke signals.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A smoke indicator apparatus, comprising:

a housing; a rotor disposed on said housing for rotating in response to wind;

a generator in said housing connected to said rotor for producing current in response to rotation of said rotor;

a reservoir in said housing for holding a fluid; and a heater in said housing having an inlet connected to said reservoir for receiving said fluid, an outlet for producing smoke, and a resistive conductor for heating said fluid in response to said current.

2. The smoke indicator apparatus described in claim 1, wherein said fluid is oil.

3. The smoke indicator apparatus described in claim 1, further comprising flow control means for controlling the flow of said fluid from said reservoir to said heater.

4. The smoke indicator apparatus described in claim 3, wherein said flow control means is a valve.

5. The smoke indicator apparatus described in claim 4, wherein said fluid is oil.

6. In a missile training pod for an aircraft producing a hit detection signal, in combination with a smoke indicator apparatus, comprising:

a rotor disposed at an end of said training pod for rotating in response to wind;

a generator connected to said rotor for producing current in response to rotation of said rotor;

a reservoir for holding a fluid;

a valve having a valve inlet and a valve outlet, said valve inlet connected to said reservoir for receiving said fluid, said valve operating in response to said hit detection signal;

a heater having a heater inlet connected to said valve outlet for receiving said fluid and a heater outlet for producing smoke, said heater having a resistive conductor for heating said fluid in response to said current.

7. The apparatus described in claim 6, wherein said fluid is oil.

8. The smoke indicator apparatus described in claim 7, wherein:

said training pod produces a fire detection signal; and said valve operates in response to said fire detection signal.

9. The smoke indicator apparatus described in claim 8, wherein said fluid is oil.

10. A method for producing smoke indications in a missile training pod for an aircraft, said training pod producing at least one detection signal, said training pod having a smoke generator for producing bursts of smoke comprising the steps of:

generating electrical current in response to wind relative to said training pod; and producing at least one burst of smoke in response to both said detection signal and said electrical current.

11. The method for producing smoke indications described in claim 10, wherein said detection signal is indicative of a simulated missile firing.

12. The method for producing smoke indications described in claim 10, wherein said detection signal is indicative of a simulated missile hit.

* * * * *